US007863881B2

(12) United States Patent
Inoue

(10) Patent No.: US 7,863,881 B2
(45) Date of Patent: Jan. 4, 2011

(54) REGULATOR CIRCUIT AND CAR PROVIDED WITH THE SAME

(75) Inventor: Hiroki Inoue, Kyoto (JP)

(73) Assignee: Rohm Co., Ltd. (JP)

( * ) Notice: Subject to any disclaimer, the term of this patent is extended or adjusted under 35 U.S.C. 154(b) by 247 days.

(21) Appl. No.: 12/096,745

(22) PCT Filed: Dec. 6, 2006

(86) PCT No.: PCT/JP2006/324335

§ 371 (c)(1),
(2), (4) Date: Jun. 9, 2008

(87) PCT Pub. No.: WO2007/066681

PCT Pub. Date: Jun. 14, 2007

(65) Prior Publication Data

US 2009/0273331 A1 Nov. 5, 2009

(30) Foreign Application Priority Data

Dec. 8, 2005 (JP) ..... 2005-355150

(51) Int. Cl.
*G05F 1/40* (2006.01)
*G05F 1/56* (2006.01)

(52) U.S. Cl. ..... 323/285; 323/282

(58) Field of Classification Search ..... 323/282, 323/284–288, 349, 351
See application file for complete search history.

(56) References Cited

U.S. PATENT DOCUMENTS 6,265,856 B1 * 7/2001 Cali' et al. ..... 323/273
2004/0263137 A1 12/2004 Okubo et al.
2006/0164047 A1 * 7/2006 Ressel ..... 323/222
2008/0180074 A1 * 7/2008 Einerman et al. ..... 323/280

FOREIGN PATENT DOCUMENTS

| | | |
|---|---|---|
| JP | 53--67848 | 6/1978 |
| JP | 8-190437 | 7/1996 |
| JP | 2000-22456 | 1/2000 |

(Continued)

OTHER PUBLICATIONS

International Preliminary Report on Patentability for International Patent Application No. PCT/JP2006/324335 issued Jun. 11, 2008 with English Translation.

(Continued)

*Primary Examiner*—Matthew V Nguyen
(74) *Attorney, Agent, or Firm*—Cantor Colburn LLP

(57) ABSTRACT

An output transistor is provided between an input terminal and an output terminal. An error amplifier adjusts the gate voltage of the output transistor such that the voltage that corresponds to the output voltage approaches a predetermined reference voltage. A fluctuation detection capacitor is provided on a path from the input terminal to a grounded terminal, which sets one terminal thereof to a fixed voltage. A current feedback circuit supplies, to the gate of the output transistor, the current that corresponds to the current that flows through the fluctuation detection capacitor. A clamp circuit clamps the gate voltage of the output transistor. The clamp circuit 30 clamps the gate voltage of the output transistor such that the voltage difference between the gate of the output transistor and the input terminal exhibits a predetermined clamp voltage or more.

18 Claims, 12 Drawing Sheets

FOREIGN PATENT DOCUMENTS

| | | |
|---|---|---|
| JP | 2001-34351 | 2/2001 |
| JP | 2001-337729 | 12/2001 |
| JP | 2002-189522 | 7/2002 |
| JP | 2002-222929 | 8/2002 |
| JP | 2002-343874 | 11/2002 |
| JP | 2003-44150 | 2/2003 |
| JP | 2006-65836 | 3/2006 |

OTHER PUBLICATIONS

International Search Report for International Patent Application No. PCT/JP2006/324335 mailed Feb. 20, 2007 with English Translation.

* cited by examiner

100a

100b

REGULATOR CIRCUIT AND CAR PROVIDED WITH THE SAME

BACKGROUND OF THE INVENTION

1. Field of the Invention

The present invention relates to a regulator circuit which maintains stable output voltage.

2. Description of the Related Art

In order to maintain stable operation of an electronic circuit, there is a demand for maintaining a stable power supply voltage at a constant value. Also, an apparatus mounting such electronic circuits does not always include a power supply voltage necessary for each of such electronic circuits. For example, a 5V microcomputer mounted in an automobile requires a power supply voltage of 5 V. However, a battery mounted in the automobile can only supply an unstable voltage of 12 V to such a 5V microcomputer mounted in the automobile. With such an arrangement, a regulator circuit is widely used in order to generate by means of a simple configuration a stable power supply voltage necessary for such an electronic circuit.

In general, such a regulator circuit includes an error amplifier, an output transistor, and a feedback resistor. The error amplifier has a function of making a comparison between a desired reference voltage value and the output voltage input as a feedback signal via the feedback resistor. Furthermore, the error amplifier has a function of controlling the voltage applied to the control terminal of the control circuit such that these two voltages thus compared approach each other. With such an arrangement, in a case that there is a change in the input voltage or a change in the load, there is a need to adjust the voltage applied to the control terminal of the output transistor according to the change in the input voltage or the change in the load.

In some cases, a MOSFET (Metal Oxide Semiconductor Field Effect Transistor) is employed as the output transistor in order to provide reduced current consumption. Let us consider an arrangement employing such a MOSFET as the output transistor. With such an arrangement, in order to provide a large current capacity, there is a need to increase the transistor size. This leads to a large gate capacitance, leading to a response delay of the gate voltage, which is controlled by the error amplifier, with respect to the change in the input voltage or the change in the load. This response delay leads to the output voltage being overshot or undershot. Also, with such an arrangement, the output voltage being thus overshot or undershot occurs due to the change in the load, i.e., the change in the output current.

In order to solve such a problem, a technique has been proposed in which the current that flows through the load from the output transistor is monitored, and the bias current applied to the error amplifier is increased according to the current thus monitored, thereby increasing the response speed of the regulator.

[Patent Document 1]

Japanese Patent Application Laid-open No. 2001-34351

With an arrangement employing the technique described in the aforementioned document, in a case that a great amount of current flows through the load, a great amount of bias current flows through the error amplifier, thereby providing the regulator circuit with an increased response speed. However, in a case that the current that flows through the load is rapidly reduced, the response speed is reduced due to the reduction in the current. In some cases, such a reduction in the response speed leads to an undesired fluctuation in the output voltage.

Furthermore, such an arrangement has a problem of difficulty in suppressing the fluctuation of the output voltage occurring due to the fluctuation of the input voltage.

SUMMARY OF THE INVENTION

The present invention has been made in view of such a problem. Accordingly, it is a general purpose of the present invention to provide a regulator circuit which is capable of suppressing fluctuations in the output voltage that arise from fluctuations in the input voltage or the output current, while suppressing an increase in power consumption in the stable state.

An embodiment of the present invention relates to a regulator circuit, which stabilizes an input voltage applied to an input terminal, and which outputs an output voltage via an output terminal. The regulator circuit comprises: an output transistor provided between the input terminal and the output terminal; an error amplifier which adjusts a voltage at a control terminal of the output transistor such that the voltage that corresponds to the output voltage approaches a predetermined reference voltage; a fluctuation detection capacitor which is provided on a path from the input terminal to the grounded terminal, and one terminal of which is set to a fixed electric potential; a current feedback circuit which supplies, to the control terminal of the output transistor, a current that corresponds to the current that flows through the fluctuation detection capacitor; and a clamp circuit which clamps the voltage of the control terminal of the output transistor.

In a case that the input voltage rises, a current, which is proportional to the time derivative of the voltage fluctuation, flows into the fluctuation detection capacitor. With such an arrangement, a current, which corresponds to the current flowing through the fluctuation detection capacitor, is supplied to the control terminal of the output transistor. This forcibly increases the voltage of the control terminal of the output transistor, thereby suppressing over shooting of the output voltage. Such an arrangement includes the clamp circuit which provides a function of clamping the voltage at the control terminal of the output transistor. The clamp circuit sets the upper limit value, the lower limit value, or both the upper limit value and the lower limit value, for the gate-source voltage or the base-emitter voltage of the output transistor (the gate-source voltage and the base-emitter voltage will be collectively referred to as "gate-source voltage" hereafter). Such an arrangement suppresses unnecessary change in the voltage at the control terminal of the output transistor, thereby further suppressing overshooting or undershooting of the output voltage.

The clamp circuit may clamp the voltage at the control terminal of the output transistor such that the voltage difference between the control terminal of the output transistor and the input terminal exhibits a predetermined clamp voltage or more.

With such an arrangement, a lower limit value is set for the difference voltage between the control terminal of the output transistor and the input terminal, i.e., the gate-source voltage. This prevents the output transistor from entering the fully OFF state. Such an arrangement prevents the output voltage from being undershot even in a case that the input voltage changes at an extremely high rate.

Also, the clamp circuit may operate during a period of time in which there is a current flowing through the fluctuation detection capacitor. With such an arrangement, the clamp circuit does not operate during a period of time in which there is no current flowing through the fluctuation detection capacitor, i.e., a period of time in which the circuit is in a steady state. In this period of time, the clamp circuit does not operates. Accordingly, the gate-source voltage is not clamped, which permits the regulator circuit to stabilize the output voltage such that the output voltage matches the reference voltage.

Also, the output transistor may be a P-channel field effect transistor. With such an arrangement, the clamp voltage may be set to a value smaller than the threshold voltage of the output transistor.

Also, the clamp circuit may include a diode provided on a current supply path from the current feedback circuit to the control terminal of the output transistor, with the cathode of the diode being connected to the control terminal side of the output transistor, and with the anode of the diode being connected to the current feedback circuit side. With such an arrangement, the clamp circuit is in an active state during a period of time in which there is a current flowing through the diode, i.e., during a period of time in which there is a current flowing through the fluctuation detection capacitor. Such an arrangement provides a function of clamping the gate-source voltage of the output transistor to be at least the forward voltage of the diode.

Also, the clamp circuit may include a resistor provided on a current supply path from the current feedback circuit to the control terminal of the output transistor. With such an arrangement, the clamp circuit is in an active state during a period of time in which there is a current flowing through the resistor, i.e., during a period of time in which there is a current flowing through the fluctuation detection capacitor. Such an arrangement provides a function of clamping the gate-source voltage of the output transistor to be at least the voltage drop which is generated by the resistor.

Also, the current feedback circuit may include: a first transistor provided on a path from the input terminal to the other terminal of the fluctuation detection capacitor; and a second transistor which forms a current mirror circuit together with the first transistor. With such an arrangement, the current feedback circuit may supply, to the control terminal of the output transistor via the clamp circuit, a current flowing through the second transistor.

Also, the clamp circuit may set the clamp voltage to a voltage which is lower than the output voltage by a differential voltage. Also, the clamp circuit may clamp the voltage at the control terminal of the output transistor so as to be at least the clamp voltage thus set.

Let us consider a case in which the input voltage that has thus fluctuated is near the reference voltage that is a target value of the output voltage, or is lower than the reference voltage (which will be referred to as the "low input voltage state" hereafter). In this case, the error amplifier reduces the voltage applied to the control terminal of the output transistor such that the output transistor enters the fully ON state, thereby increasing the gate-source voltage thereof. With such an arrangement, a lower limit value is set for the voltage applied to the control terminal of the output transistor. Accordingly, the gate-source voltage of the output transistor is clamped at a predetermined voltage. Such an arrangement suppresses overshooting of the output voltage even if the input voltage rapidly rises from the low input voltage state.

Also, the clamp circuit may set the clamp voltage using as the differential voltage a voltage which is increased according to the output current that flows through the output transistor.

With such an arrangement, the differential voltage is increased according to an increase in the output current. Such an arrangement has a function of reducing the lower limit value of the voltage applied to the control terminal of the output transistor according to an increase in the load amount. Thus, such an arrangement provides a function of setting the upper limit level of the ON state of the output transistor according to a load current, thereby more suitably suppressing overshooting of the output voltage.

Also, the clamp circuit may include: a current detection circuit which generates a detection current that corresponds to the output current that flows through the output transistor; a clamp reference voltage generating circuit which generates a clamp reference voltage that is lower than the output voltage by a voltage which is proportional to the detection current; and a clamp execution circuit which sets the clamp voltage to a voltage which is lower by a predetermined voltage than the clamp reference voltage thus generated by the clamp reference voltage generating circuit.

With such an arrangement, the differential voltage thus set is provided as the sum of a predetermined voltage and a voltage which is proportional to the output current flowing through the output transistor.

Also, the clamp reference voltage generating circuit may include a resistor, one terminal of which is connected to the output terminal, and which is provided on a path for the detection current generated by the current detection circuit. With such an arrangement, the voltage at the other terminal of the resistor may be output as the clamp reference voltage.

Also, the clamp execution circuit may include a diode which is provided on a path from the output terminal of the clamp reference voltage generating circuit to the control terminal of the output transistor such that the cathode terminal thereof is connected to the control terminal side of the output transistor.

Also, the clamp execution circuit may include: an N-channel field effect transistor, with the clamp reference voltage applied to the gate thereof; and a diode, the anode of which is connected to the source of the N-channel field effect transistor, and the cathode of which is connected to the control terminal of the output transistor.

Also, the regulator circuit may be integrally formed on a single semiconductor substrate. Examples of arrangements "integrally formed" include: an arrangement in which all the components of a circuit are formed on a semiconductor substrate; and an arrangement in which principal components of a circuit are integrally formed. With such an arrangement, a part of the resistors, capacitors, and so forth, for adjusting circuit constants, may be provided in the form of components external to the semiconductor substrate.

Another embodiment of the present invention relates to an automobile. The automobile includes: a battery; and the above-described regulator circuit which stabilizes the voltage supplied from the battery before supplying the output voltage to a load.

Such an arrangement suppresses overshooting and undershooting of the voltage supplied to a load even if the battery voltage fluctuates. Thus, such an arrangement provides stable driving of the load.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

While the preferred embodiments of the present invention have been described using specific terms, such description is for illustrative purposes only, and it is to be understood that changes and variations may be made without departing from the spirit or scope of the appended claims.

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A and the member B are physically and directly connected to each other. Also, the state represented by such a phrase include a state in which the member A and the member B are indirectly connected to each other via another member that does not affect the electric connection between the member A and the member B.

(Outline of an Embodiment According to the Present Invention)

Figure 1:
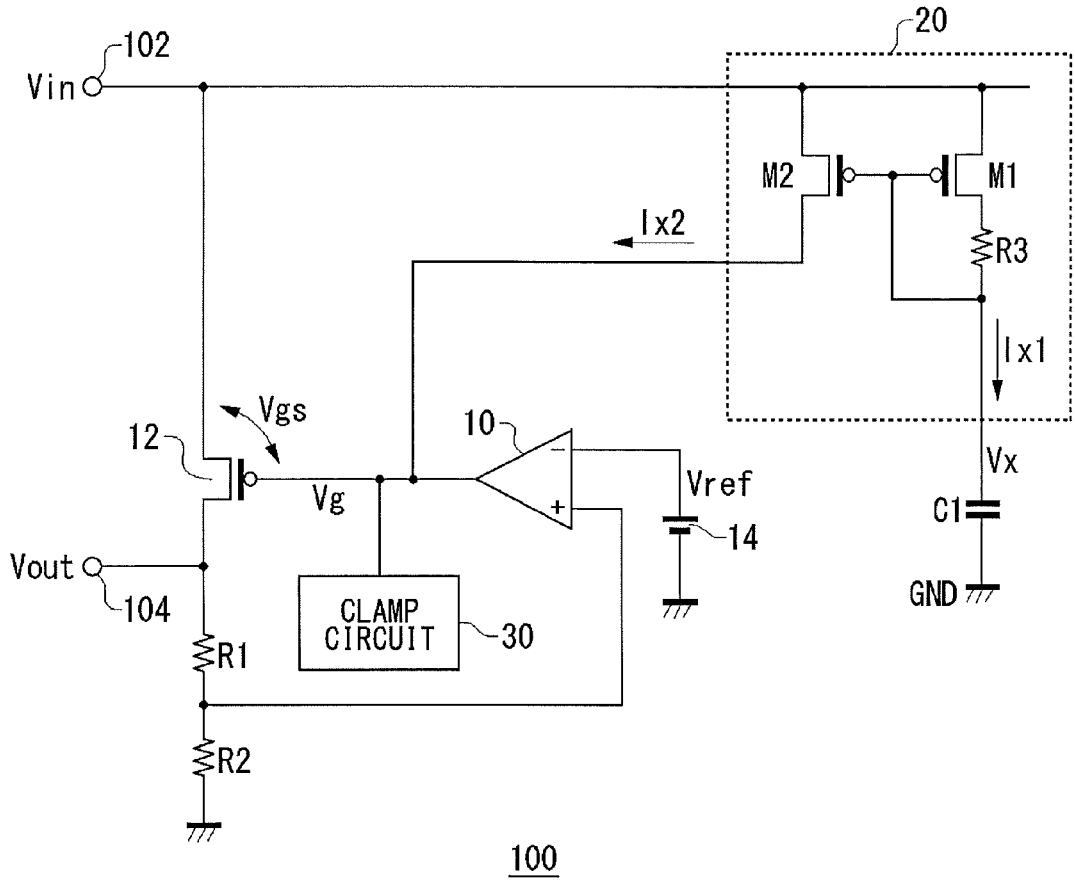
FIG. 1 is a block diagram which shows a configuration of a regulator circuit according to an embodiment.

First, description will be made regarding the outline of the configuration and the operation of a regulator circuit 100 according to an embodiment of the present invention. FIG. 1 is a block diagram which shows a configuration of the regulator circuit 100 according to the present embodiment. In the following drawings, the same reference components are denoted by the same reference numerals, and description thereof will be omitted as appropriate. In the following description, as necessary, the reference numerals which denote a voltage signal, a current signal, resistance, capacitance, etc., also denote the corresponding voltage value, current value, resistance value, capacitance value, etc., respectively.

The regulator circuit 100 according to the present embodiment stabilizes the input voltage Vin applied to the input terminal 102, and outputs the output voltage Vout via the output terminal 104. The regulator circuit 100 includes a fluctuation detection capacitor C1, a current feedback circuit 20, and a clamp circuit 30, in addition to an error amplifier 10, an output transistor 12, a first resistor R1, a second resistor R2, and a reference voltage source 14.

The error amplifier 10, the output transistor 12, the first resistor R1, and the second resistor R2 form a typical linear regulator. The output transistor 12 is provided between the first terminal 102 and the output terminal 104. Such an arrangement has a function of adjusting the voltage drop with respect to the input voltage Vin so as to obtain a desired output voltage Vout. With the present embodiment, the output transistor 12 is a P-channel MOSFET. The source of the output transistor 12 is connected to the input terminal 102 of the regulator circuit 100. On the other hand, the drain thereof is connected to the output terminal 104. Furthermore, the gate thereof, which is a control terminal thereof, is connected to the output of the error amplifier 10. With such an arrangement, the error amplifier 10 controls the gate voltage Vg.

The reference voltage Vref output from the reference voltage source 14 is input to the inverting input terminal (−) of the error amplifier 10. On the other hand, the output voltage Vout is divided by the first resistor R1 and the second resistor R2. The voltage R2/(R1+R2)×Vout thus divided is input to the non-inverting input terminal (+) of the error amplifier 10 in the form of a feedback input signal. The error amplifier 10 adjusts the gate voltage Vg of the output transistor 12 such that the voltage input to the inverting input terminal matches the voltage input to the non-inverting input terminal. Thus, such an arrangement stabilizes the output voltage such that it satisfies the Expression Vout=(R1+R2)/R2×Vref, regardless of the value of the input voltage Vin.

The fluctuation detection capacitor C1 is provided on a path from the input terminal 102 to the grounded terminal GND. One terminal of the fluctuation detection capacitor C1 is grounded, i.e., is set to a fixed electric potential. The current feedback circuit 20 supplies the current Ix2, which corresponds to the current Ix1 flowing through the fluctuation detection capacitor C1, to the gate of the output transistor 12. The fluctuation detection capacitor C1 and the current feedback circuit 20 provide a function whereby, in a case that the input voltage Vin applied to the input terminal 102 rapidly changes, overshooting of the output voltage is suppressed.

In a case that a current flows from the input terminal 102 into the other terminal of the fluctuation detection capacitor C1, the current feedback circuit 20 forcibly raises the gate voltage Vg of the output transistor 12. Specifically, the current feedback circuit 20 supplies the current Ix2, which corresponds to the current Ix1 flowing from the input terminal 102 into the other terminal of the fluctuation detection capacitor C1, to the gate of the output transistor 12.

The current feedback circuit 20 may be provided in the form of a current mirror circuit, for example. With the present embodiment, the current feedback circuit 20 includes a first transistor M1, a second transistor M2, and a gain adjustment resistor R3. The first transistor M1 and the gain adjustment resistor R3 are serially connected to each other on a path from the input terminal 102 to the other terminal of the fluctuation detection capacitor C1. The first transistor M1 is a P-channel MOSFET. The source of the first transistor M1 is connected to the input terminal 102. Furthermore, the drain thereof is connected to the gain adjustment resistor R3. Also, the second transistor M2 is a P-cannel MOSFET. The source of the second transistor M2 is connected to the input terminal 102. Furthermore, the gate thereof is connected to the gate of the first transistor M1. The second transistor M2 and the first transistor M1 together forma current mirror circuit. With such an arrangement, the first transistor M1 and the second transistor M2 supply the current Ix2 to the gate of the output transistor 12, which is proportional, by a constant factor, to the current Ix1 that flows into the fluctuation detection capacitor C1 from the input terminal 102. Thus, such an arrangement provides a function of forcibly raising the gate voltage Vg.

Let us consider a case in which the circuit is in a stable state. In this case, the current that flows through the first transistor M1 is almost zero. Accordingly, the voltage difference between the drain and the source of the first transistor M1 is almost 0 V. Furthermore, the voltage drop at the gain adjustment resistor R3 is almost 0V. Accordingly, approximately the same voltage as the input voltage Vin is input to the one terminal of the fluctuation detection capacitor C1. That is to say, it satisfies the Expression Vx≈Vin. On the other hand, the sum of the drain-source voltage of the first transistor M1 and the voltage drop at the gain adjustment resistor R3 corresponds to the gate-source voltage of the second transistor M2. In this case, each of these voltages is extremely small, and accordingly, the second transistor M2 is in the OFF state.

Let us consider a case in which there is an increase in the input voltage Vin applied to the input terminal 102. In this case, the voltage applied to the terminal on the higher potential side of the fluctuation detection capacitor C1 is increased according to the input voltage Vin. Accordingly, transient current Ix1 flows through the first transistor M1 and the gain adjustment resistor R3, thereby charging the fluctuation detection capacitor C1.

The current feedback circuit 20 amplifies the current Ix1, i.e., generates the current Ix2. The current Ix2 is input as a feedback signal to the gate of the output transistor 12, which is a control terminal thereof. Note that the current Ix1 may be amplified with a gain less than 1. With such an arrangement, the ratio of the current Ix1 to Ix2 can be adjusted by adjusting the gain adjustment resistor R3 and the size ratio of the first transistor M1 to the second transistor M2. Specifically, in order to increase the current gain, the size ratio of the first transistor M1 to the second transistor M2 should be increased. Alternatively, the resistance value of the gain adjustment resistor R3 should be increased.

The clamp circuit 30 clamps the voltage applied to the control terminal of the output transistor 12, i.e., the gate voltage Vg. The clamp circuit 30 clamps the gate voltage Vg of the output transistor 12, thereby setting the upper limit value of the gate-source voltage Vgs of the output transistor 12, the lower limit value thereof, or both the upper limit and the lower limit thereof.

Figure 2:
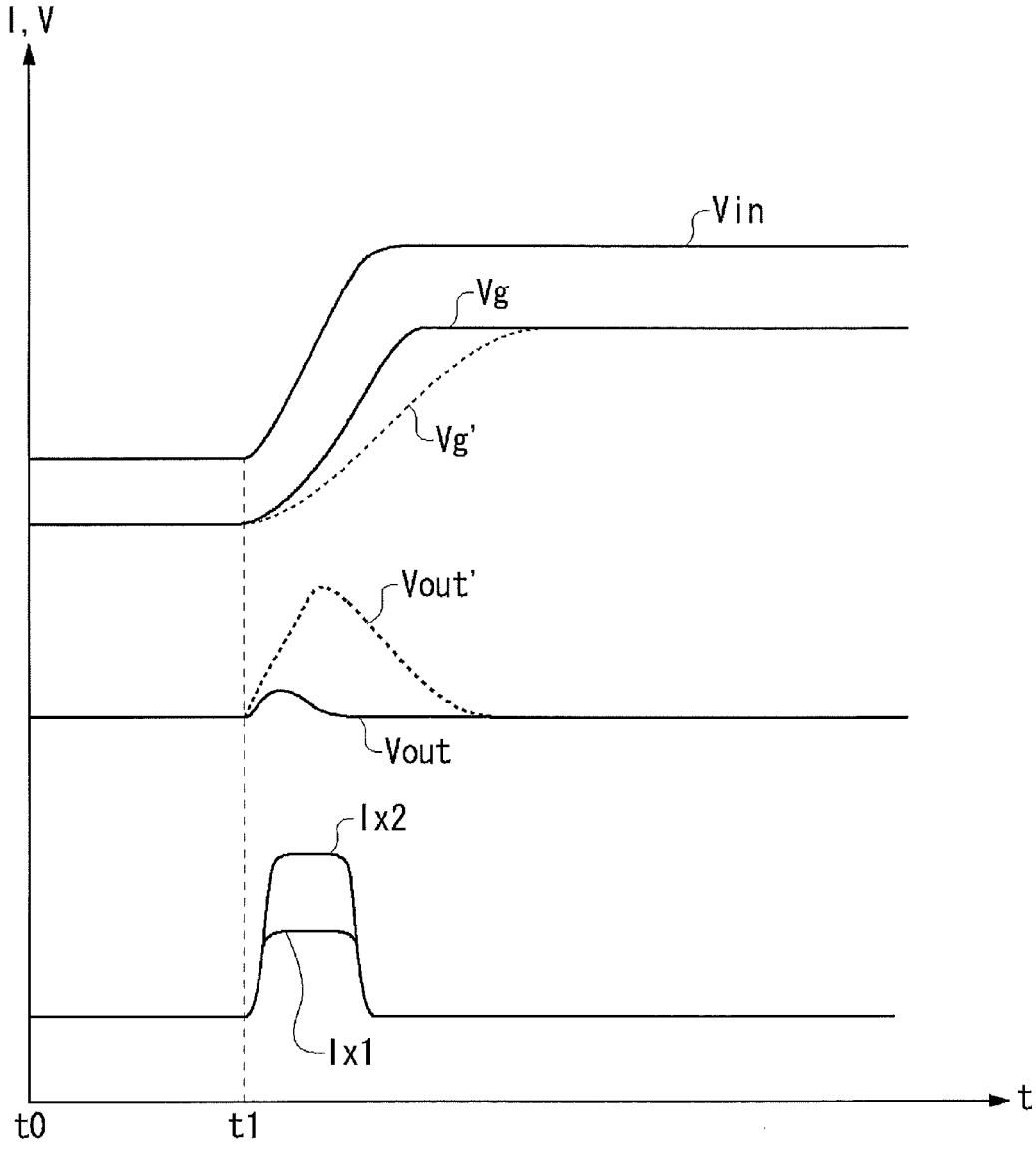
FIG. 2 is an operation waveform diagram for the regulator circuit shown in FIG. 1 when the input voltage rapidly rises.

Next, description will be made regarding an overshoot suppressing function of the regulator circuit 100 shown in FIG. 1, with reference to FIG. 2. FIG. 2 is an operation waveform diagram for the regulator circuit 100 when the input voltage Vin rapidly rises. In the following drawings, in order to facilitate understanding of the operation of the regulator circuit 100, the vertical axis and the horizontal axis are expanded or reduced as appropriate, i.e., are shown with a scale that differs from the actual scale.

In order to further clarify the overshoot suppressing function of the regulator circuit 100 according to the present embodiment, first, description will be made regarding the operation of the regulator circuit 100 without involving the fluctuation detection capacitor C1 and the current feedback circuit 20. The gate voltage Vg' and the output voltage Vout' in this operation are indicated by the broken lines in FIG. 2.

During a period from the point in time t0 to the point in time t1, the input voltage Vin is maintained at a constant value, i.e., the circuit is in a stable state. In this period of time, the output voltage is regulated to Vout=(R1+R2)/R2×Vref. Let us consider a case in which the input voltage Vin rapidly rises at the point in time t1.

With such an arrangement, a time constant circuit composed of a gate capacitance leads to delay in the response of the gate voltage Vg'. Accordingly, the gate voltage Vg' cannot exhibit a sufficient response to a rapid rise in the input voltage Vin which is the source voltage. This leads to a temporary increase in the gate-source voltage of the output transistor 12, resulting in the output voltage being overshot.

Next, description will be made regarding the operation of the regulator circuit 100 according to an embodiment of the present invention with reference to the voltage waveforms Vg and Vout (indicated by the solid lines in FIG. 2). With the regulator circuit 100 according to the present embodiment, the fluctuation detection capacitor C1 and the current feedback circuit 20 operate so as to prevent the output voltage being overshot.

During a period from the point in time t0 to the point in time t1, the circuit is in a stable state. At the point in time t1, the input voltage Vin rises. In a case that the input voltage Vin rises, the current Ix1 flows from the input terminal 102 into the fluctuation detection capacitor C1. The current Ix1 is represented using the capacitance value of the fluctuation detection capacitor C1, i.e., is represented by the Expression Ix1≈C1×dVin/dt. Accordingly, in FIG. 2, the current Ix1 is approximately proportional to the waveform of the time derivative of the input voltage Vin. With such an arrangement, in a case that the input voltage Vin changes, the current Ix1 flows.

The current Ix1 is amplified by the current feedback circuit 20, thereby generating the current Ix2. The amplification factor is determined by the first transistor M1, the second transistor M2, and the gain adjustment resistor R3, as described above. The current Ix2 thus amplified by the current feedback circuit 20 is supplied to the gate of the output transistor 12. In this stage, the current Ix2 charges the gate capacitance Cg of the output transistor 12. This means that the charge current I is increased by the current Ix2, thereby increasing the rate of change in the gate voltage Vg over time according to the relation dVg/dt=I/Cg. As a result, as indicated by the solid line in FIG. 2, the gate voltage Vg rises more rapidly than the gate voltage Vg' (indicated by the broken line in FIG. 2).

Thus, with such an arrangement, the gate-source voltage Vgs of the output transistor 12 is adjusted to an appropriate value even in a case of fluctuations in the input voltage Vin, which is the source voltage. Such an arrangement suppresses overshooting of the output voltage Vout (indicated by the solid line).

As described above, with the regulator circuit 100 according to the present embodiment, the current feedback circuit 20 detects the transient current Ix1 that flows during a period in which the input voltage Vin changes. The current Ix1 thus detected is amplified, and the current thus amplified is supplied to the gate terminal of the output transistor 12. Thus, such an arrangement has a function of preventing the output voltage Vout being overshot, by forcibly raising the gate voltage Vg.

Furthermore, such an arrangement has an advantage of a reduced capacitance value of a capacitor (not shown) ordinarily provided between the output terminal 104 and the grounded terminal, which is due to the overshoot suppressing function of the regulator circuit 100*a*.

With such an arrangement, the currents Ix1 and Ix2 are proportional to the time derivative of the input voltage Vin as described above. Accordingly, each of the currents Ix1 and Ix2 flows only during a period in which the input voltage Vin changes overtime. Thus, the regulator circuit 100 according to the present embodiment suppresses overshooting of the output voltage Vout without a need to increase current consumption in a stable state.

As described above, with the regulator circuit 100 according to the present embodiment, in a case that the input voltage Vin changes, a combination of the fluctuation detection capacitor C1 and the current feedback circuit 20 forcibly changes the gate voltage Vg of the output transistor 12 so as to suppress overshooting of the output voltage. The clamp circuit 30 sets the upper limit of the gate-source voltage Vgs of the output transistor 12, the lower limit thereof, or both the upper limit and the lower limit thereof. Description will be made below regarding an arrangement in which the lower limit of the gate-source voltage Vgs of the output transistor 12 is set, and an arrangement in which the upper limit thereof is set, in that order, with respect to the first and second embodiments.

First Embodiment

Description will be made in the first embodiment regarding an arrangement in which the clamp circuit 30 shown in FIG. 1 sets the lower limit value of the gate-source voltage Vgs of the output transistor 12. First, description will be made regarding the operation of the clamp circuit 30. Next, description will be made regarding a specific example of a configuration thereof.

As described above, the current that is supplied to the gate of the output transistor 12 from the current feedback circuit 20 is proportional to the rate of change in the input voltage Vin over time. Accordingly, in a case that the input voltage Vin changes at an extremely high rate, excessive current is supplied to the gate of the output transistor 12. In some cases, this leads to an extreme reduction in the gate-source voltage of the output transistor 12. This leads to an extreme increase in the drain-source voltage Vds, resulting in the output voltage being undershot. With the present embodiment, the clamp circuit 30 shown in FIG. 1 provides a function of suppressing undershooting of the output voltage as described below.

Figure 3:
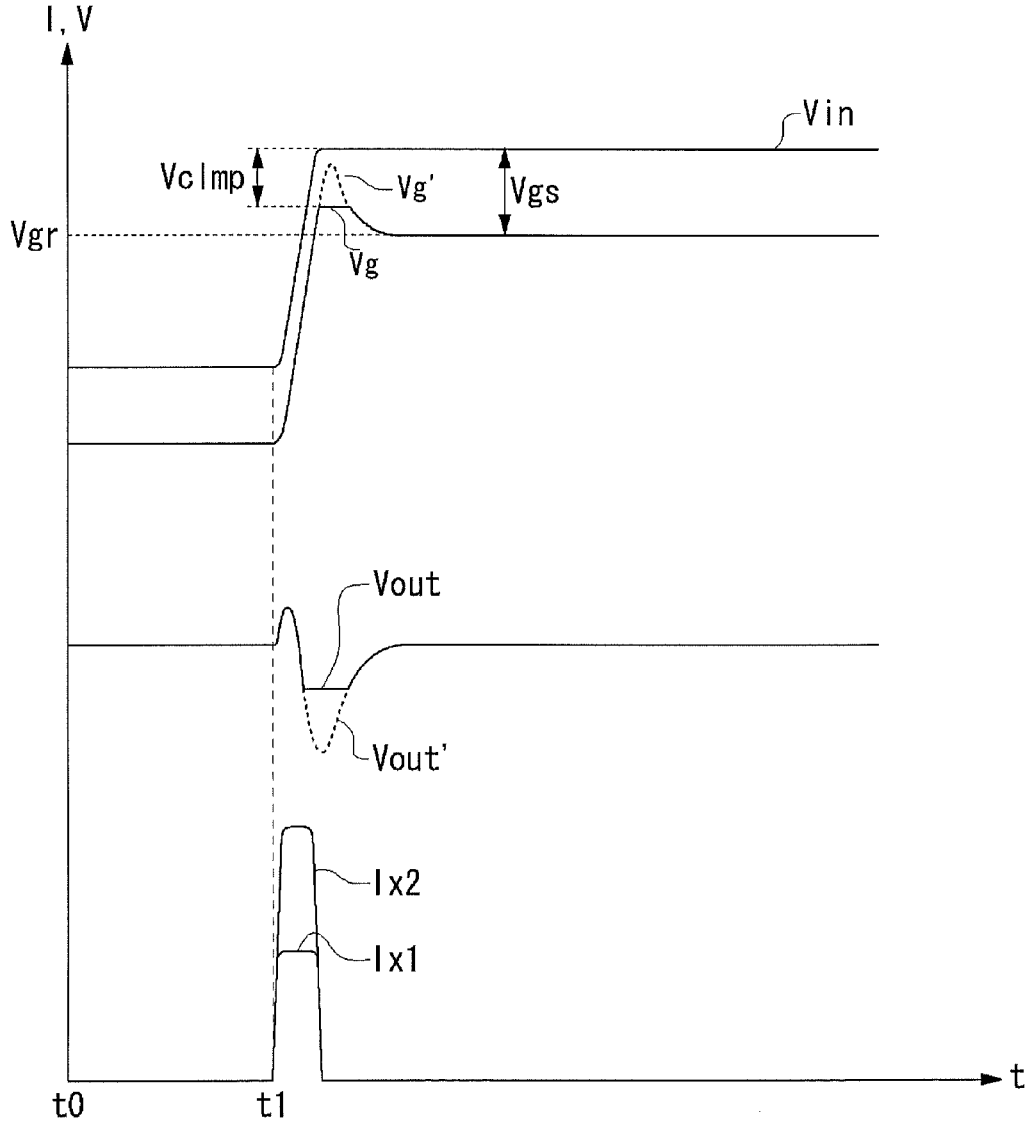
FIG. 3 is an operation waveform diagram for a regulator circuit according to a first embodiment.

FIG. 3 is an operation waveform diagram or the regulator circuit 100 shown in FIG. 1 with the lower limit value of the gate-source voltage Vgs of the output transistor 12 having been set. First, description will be made regarding the operation of the regulator circuit 100 without involving the clamp circuit 30, to clarify the advantage in the clamp circuit 30. The waveforms of the gate voltage Vg' and the output voltage Vout' in this operation are indicated by the broken lines in FIG. 3.

During a period from the point in time t0 to the point in time t1, the input voltage Vin is constant, i.e., the circuit is in a stable state. In this stage, the output voltage is regulated to Vout=(R1+R2)/R2×Vref. Now, let us consider a case in which the input voltage Vin rapidly rises. Here, let us say that the rate of change in the input voltage Vin is greater than that shown in FIG. 2.

In this stage, the current Ix1, which is proportional to the rate of change in the input voltage Vin over time, i.e., dVin/dt, flows through the fluctuation detection capacitor C1. Accordingly, in this case, there is an extreme increase in the current Ix2, which is supplied to the gate of the output transistor 12, as compared with a case as shown in FIG. 2. In a case that excessive current is supplied to the gate capacitance of the output transistor 12, the gate voltage rises beyond the voltage Vgr which is to be maintained, and which provides a desired output voltage. This leads to an extreme reduction in the gate-source voltage Vgs of the output transistor 12. Furthermore, this leads to an increase in the drain-source voltage Vds of the output transistor 12, resulting in the output voltage Vout' being undershot (as indicated by the broken line).

Next, description will be made regarding the operation of the regulator circuit 100 according to the present embodiment of the present invention with reference to the voltage waveforms Vg and Vout indicated by the solid lines in FIG. 3. The regulator circuit 100 includes the clamp circuit 30 which sets the lower limit value of the gate-source voltage Vgs of the output transistor 12 (which will be referred to as the "clamp voltage Vclmp" hereafter).

At the point in time t1, the input voltage Vin rapidly rises. The current Ix2, which is proportional to the rate of change of the input voltage Vin over time, is supplied to the gate of the output transistor 12, leading to a rapid increase in the gate voltage Vg. This leads to a reduction in the gate-source voltage Vg, and at the point in time t1, the gate-source voltage Vgs reaches the clamp voltage Vclmp. After the gate-source voltage Vg reaches the clamp voltage Vclmp, the gate voltage Vg is clamped. With such an arrangement, the output transistor 12 does not enter the fully OFF state. Such an arrangement prevents the drain-source voltage Vds from excessively increasing, thereby suppressing undershooting of the output voltage Vout.

Figure 4:
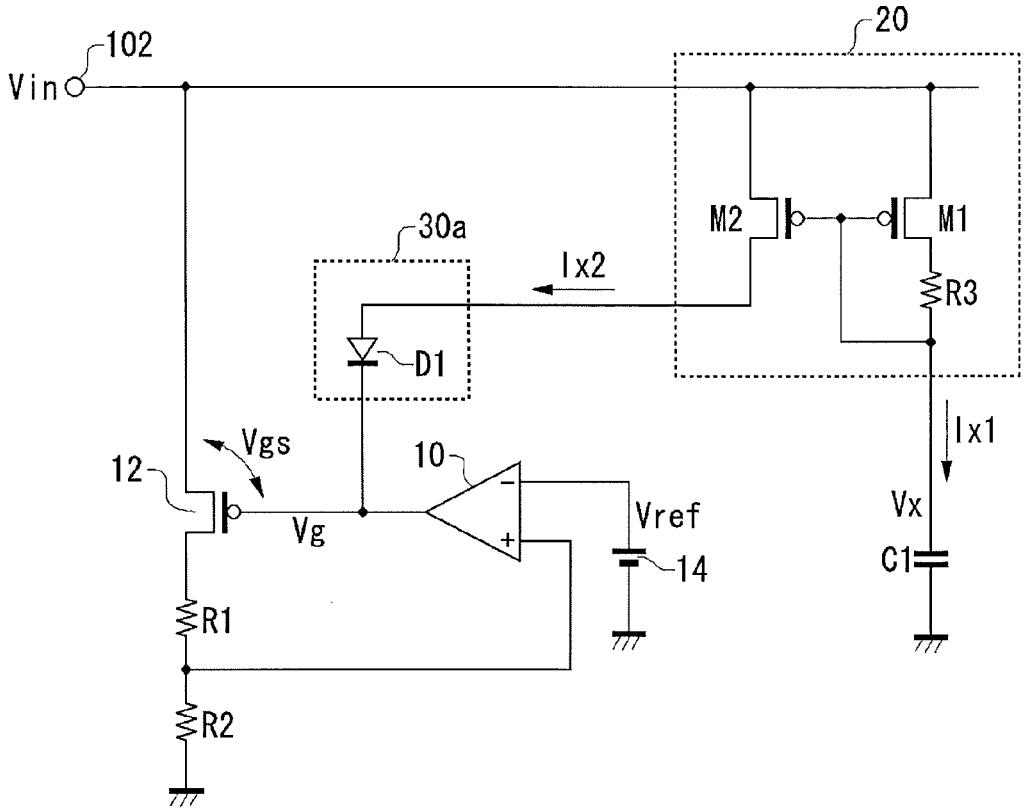
FIG. 4 is a circuit diagram which shows an example of a configuration of the regulator circuit according to the first embodiment.

Next, description will be made regarding an example of a configuration of the clamp circuit 30. FIG. 4 is a circuit diagram which shows an example of a configuration of the regulator circuit 100*a* according to the present embodiment. The clamp circuit 30*a* included in the regulator circuit 100*a* according to the present embodiment includes a first diode D1. The first diode D1 is provided on a current supply path from the current feedback circuit 20 to the gate of the output transistor 12. With such an arrangement, the cathode of the first diode D1 is connected to the gate side of the output transistor 12. On the other hand, the anode thereof is connected to the current feedback circuit 20 side. The first diode D1 may be provided in the form of a diode element including a PN junction, a bipolar transistor in which the base and the collector are connected to each other, a MOSFET body diode, or the like.

The clamp circuit 30*a* included in the regulator circuit 100*a* according to the present embodiment has a function of clamping the voltage difference between the gate of the output transistor 12 and the input terminal 102, i.e., the gate-source voltage Vgs of the output transistor 12, so as to be the forward voltage Vf (around 0.7 V) of the first diode D1 or more. More precisely, the regulator circuit 100*a* according to the present embodiment clamps the gate-source voltage Vgs of the output transistor 12 to be equal to or greater than the sum of the forward voltage Vf of the diode and the drain-source voltage Vds of the second transistor M2.

Note that, with the clamp circuit 30*a* having such a configuration, the first diode D1 may be replaced by a resistor. With such an arrangement, the clamp voltage Vclmp is set to the value obtained by multiplying the current Ix2 by the resistance value, i.e., the value of the voltage drop at the resistor. With such an arrangement, the clamp voltage Vclmp can be adjusted by selecting a resistance value. Also, the clamp circuit 30*a* may have a configuration in which a diode and a resistor are serially connected.

The clamp circuit 30*a* having such a configuration operates in an active state during a period of time when the current Ix1 flows through the fluctuation detection capacitor C1. That is to say, during a period of time in which the current Ix1 does not flow through the fluctuation detection capacitor C1, the first transistor M1 and the second transistor M2 are in the OFF state. Accordingly, the current Ix2 also does not flow. Accordingly, in this period, the operation of the clamp circuit 30*a* is negligible. Now, let us consider a case in which the input voltage Vin changes, which leads to the currents Ix1 and Ix2 flowing. In this case, the electric potential difference occurs between the anode and cathode of the first diode D1, whereby the clamp circuit 30 clamps the gate voltage Vg of the output transistor 12.

As described above, the clamp circuit 30*a* operates only in a case that the input voltage Vin changes. On the other hand, the gate-source voltage Vgs of the output transistor 12 is not clamped in a normal state. Such an arrangement ensures that the on-resistance of the output transistor 12 is controlled without any restriction imposed by the clamp circuit 30*a*, thereby stabilizing the output voltage Vout to a desired voltage.

Note that, typically, the output transistor 12 has a gate-source threshold voltage Vth in a range between 1 V and 2 V, depending upon the manufacturing process. On the other hand, with the regulator circuit 100*a* according to the present embodiment, the clamp voltage Vclmp is set to approximately 0.7V. As described above, with such an arrangement, the clamp voltage Vclmp is set to a value smaller than the threshold voltage Vth of the output transistor 12. Such an arrangement provides a suitable balance between the overshoot suppressing function, which is provided by the detection capacitor C1 and the current feedback circuit 20, and the undershoot suppressing function which is provided by the clamp circuit 30.

Second Embodiment

Description will be made in the second embodiment regarding an arrangement in which the clamp circuit 30 sets the upper limit value of the gate-source voltage Vgs of the output transistor 12. First, description will be made regarding the operation of the clamp circuit 30. Next, description will be made regarding a specific example of a configuration thereof.

With the present embodiment, the clamp circuit 30 clamps the gate voltage Vg of the output transistor 12 to the clamp voltage Vclmp or more.

Figure 5:
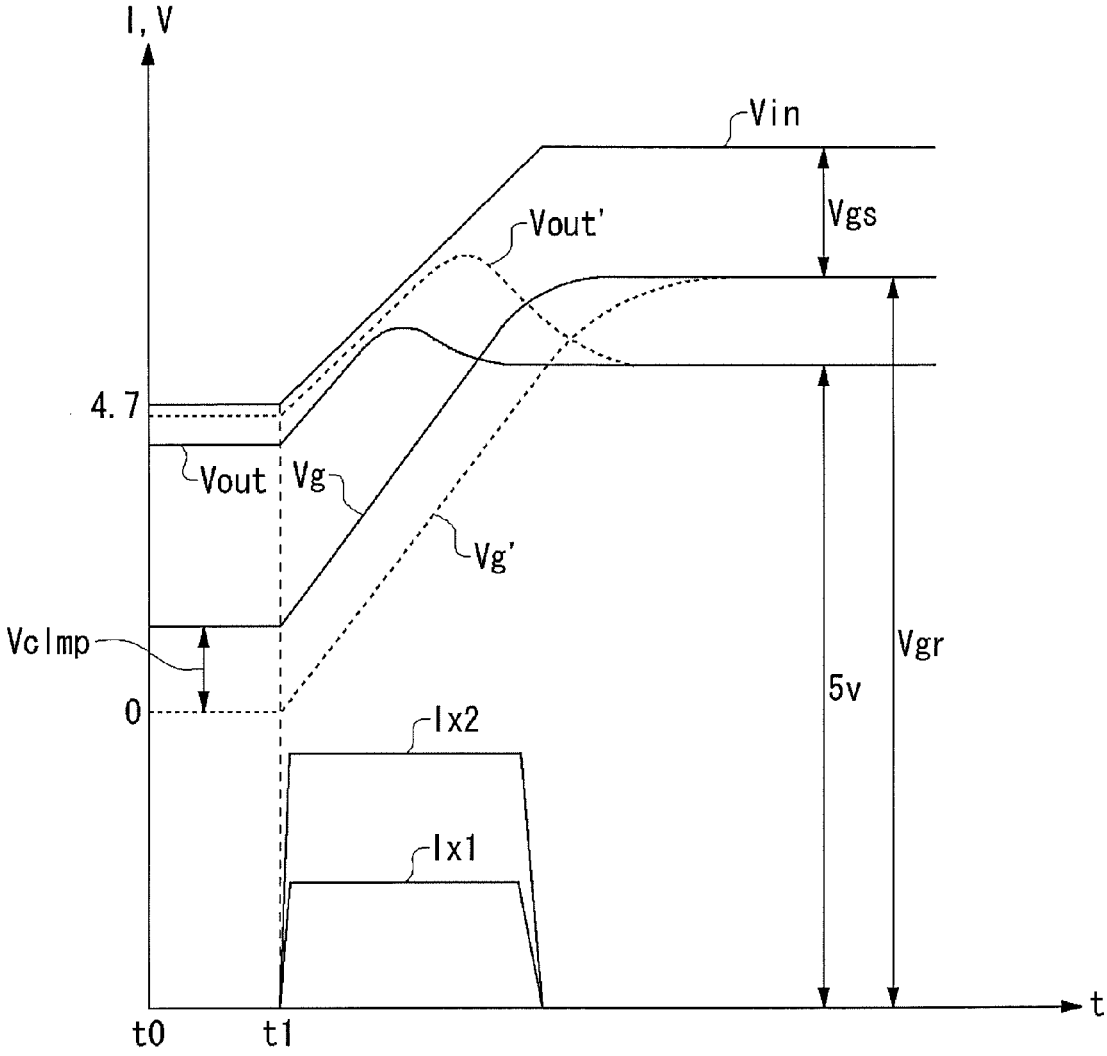
FIG. 5 is an operation waveform diagram for a regulator circuit according to a second embodiment.

FIG. 5 is an operation waveform diagram for the regulator circuit 100 according to a second embodiment. First, description will be made regarding the operation of the regulator circuit 100 without involving the function of the clamp circuit 30, to clarify the advantage in the clamp circuit 30. The waveforms of the gate voltage Vg' and the output voltage Vout' in this operation are indicated by the broken lines in FIG. 5.

Let us consider a case in which, during a period from the point in time t0 to the point in time t1, the input voltage Vin is a lower voltage (e.g., 4.7 V) than the target voltage (e.g., 5 V) of the output voltage. In this case, the output transistor 12 is in the fully ON state. Accordingly, the output voltage Vout is stabilized to a voltage slightly lower than the input voltage Vin. In this stage, the gate voltage Vg' of the output transistor 12 is reduced to around 0 V so as to set the output transistor 12 to the fully ON state.

In this stage, at the point in time t1, the input voltage Vin rapidly rises. As a result, the current Ix2, which has been generated due to fluctuation in the input voltage Vin, and which is proportional to the rate of change in the input voltage Vin over time, is supplied to the gate of the output transistor 12, which causes the gate voltage Vg' to start to rise. However, in this case, the gate voltage Vg' has been reduced to around 0 V. Accordingly, in this case, the input voltage Vin rises while the output transistor 12 is in the fully ON state, i.e., the drain-source voltage Vds of the output transistor 12 is approximately 0 V. As a result, upon the voltage starting to rise, the output voltage Vout rises beyond the target voltage. In some cases, without the function of the clamp circuit 30, such a situation leads to the output voltage being overshot.

Next, description will be made regarding the regulator circuit 100 according to an embodiment of the present invention, with the clamp circuit 30 operating, with reference to the waveforms Vg and Vout indicated by the solid lines in FIG. 5.

During a period from the point in time t0 to the point in time t1, i.e., in a state in which the low input voltage is input, the clamp circuit 30 clamps the gate voltage Vg to the clamp voltage Vclmp or more. Setting the lower limit value of the gate voltage Vg is equivalent to setting the upper limit of the gate-source voltage Vgs of the output transistor 12. Setting the upper limit value of the gate-source voltage Vgs prevents the output transistor 12 from entering the fully ON state. Accordingly, the output voltage Vout is lower than the output voltage Vout' indicated by the broken line during the period from the point in time t0 to the point in time t1.

At the point in time t1, the input voltage Vin rises, leading to the current Ix2 flowing. The current Ix2 charges the gate capacitance of the output transistor 12, which increases the gate voltage Vg. In this stage, the gate-source voltage Vgs of the output transistor 12 is lower, by approximately the clamp voltage Vclmp, than the gate-source voltage Vgs provided by an arrangement operating without involving the function of the clamp circuit 30. This ensures that the output transistor 12 does not enter the fully ON state. Thus, such an arrangement ensures that the input voltage Vin rises while maintaining the drain-source voltage Vds at a certain value or more. This prevents the output voltage Vout from rising corresponding to the input voltage Vin, thereby suppressing overshooting of the output voltage.

Figure 6:
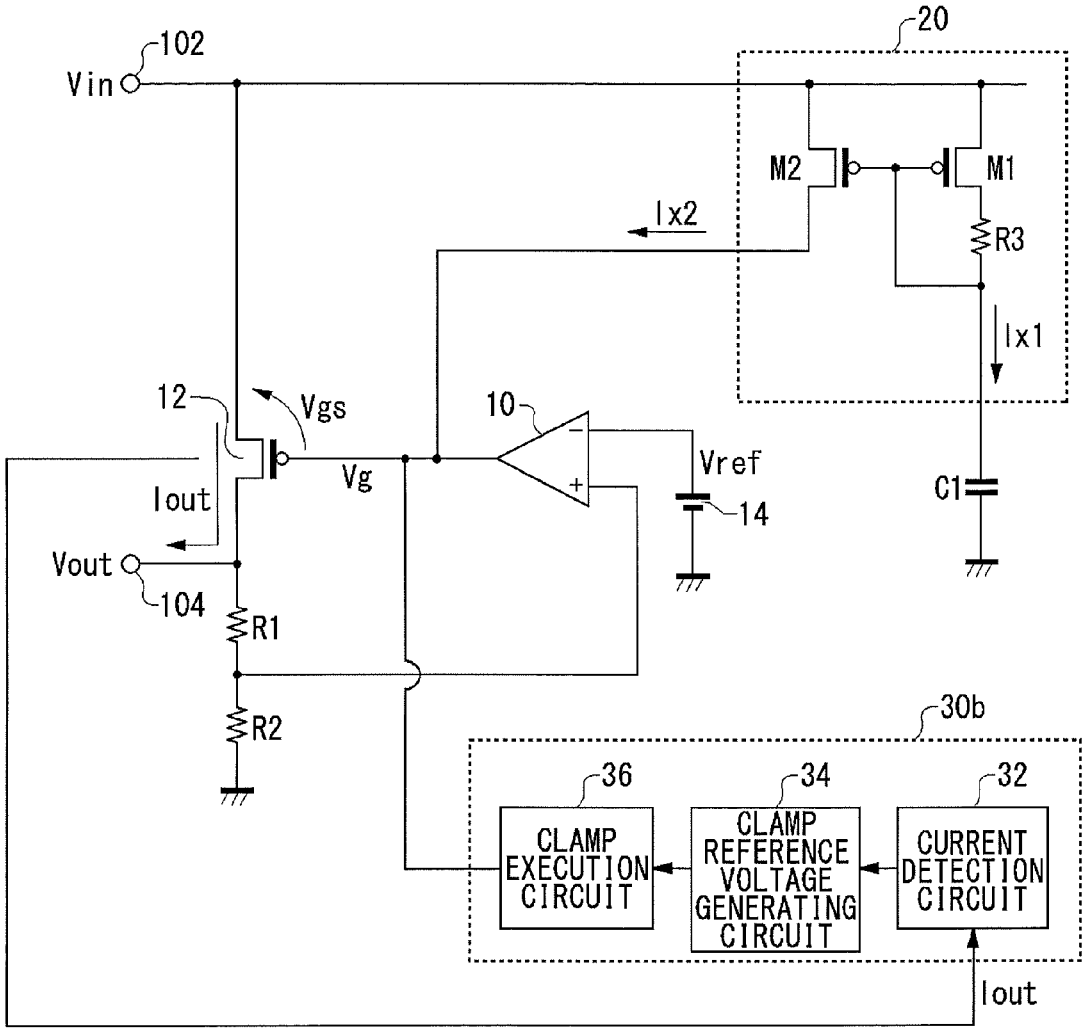
FIG. 6 is a circuit diagram which shows an example of a configuration of the regulator circuit according to the second embodiment.

FIG. 6 is a circuit diagram which shows an example of a configuration of a regulator circuit 100*b* according to the second embodiment. A clamp circuit 30*b* included in the regulator circuit 100*b* sets the clamp voltage Vclmp to a voltage that is lower than the output voltage Vout by the differential voltage ΔV. With such an arrangement, the gate voltage Vg of the output transistor 12 is clamped to the clamp voltage Vclmp or more. With the present embodiment, the differential voltage ΔV is a voltage which increases according to the output current Iout that flows through the output transistor 12. Also, the differential voltage ΔV may be set to the sum of the component ΔV1, which increases in proportion to the output current Iout that flows through the output transistor 12, and a predetermined fixed voltage ΔV2.

The clamp circuit 30*b* includes a current detection circuit 32, a clamp reference voltage generating circuit 34, and a clamp execution circuit 36. The current detection circuit 32 generates the detection current Idet that corresponds to the output current Iout that flows through the output transistor 12. The clamp reference voltage generating circuit 34 generates the clamp reference voltage Vclmpref, which is lower than the output voltage Vout by the voltage ΔV1 that is proportional to the detection current Idet. That is to say, it satisfies the Expression Vclmpref=Vout−ΔV1.

The clamp execution circuit 36 sets the clamp voltage Vclmp to a voltage that is lower by the predetermined voltage ΔV2 than the clamp reference voltage Vclmpref generated by the clamp reference voltage generating circuit 34, and clamps the gate voltage Vg of the output transistor 12.

Figure 7:
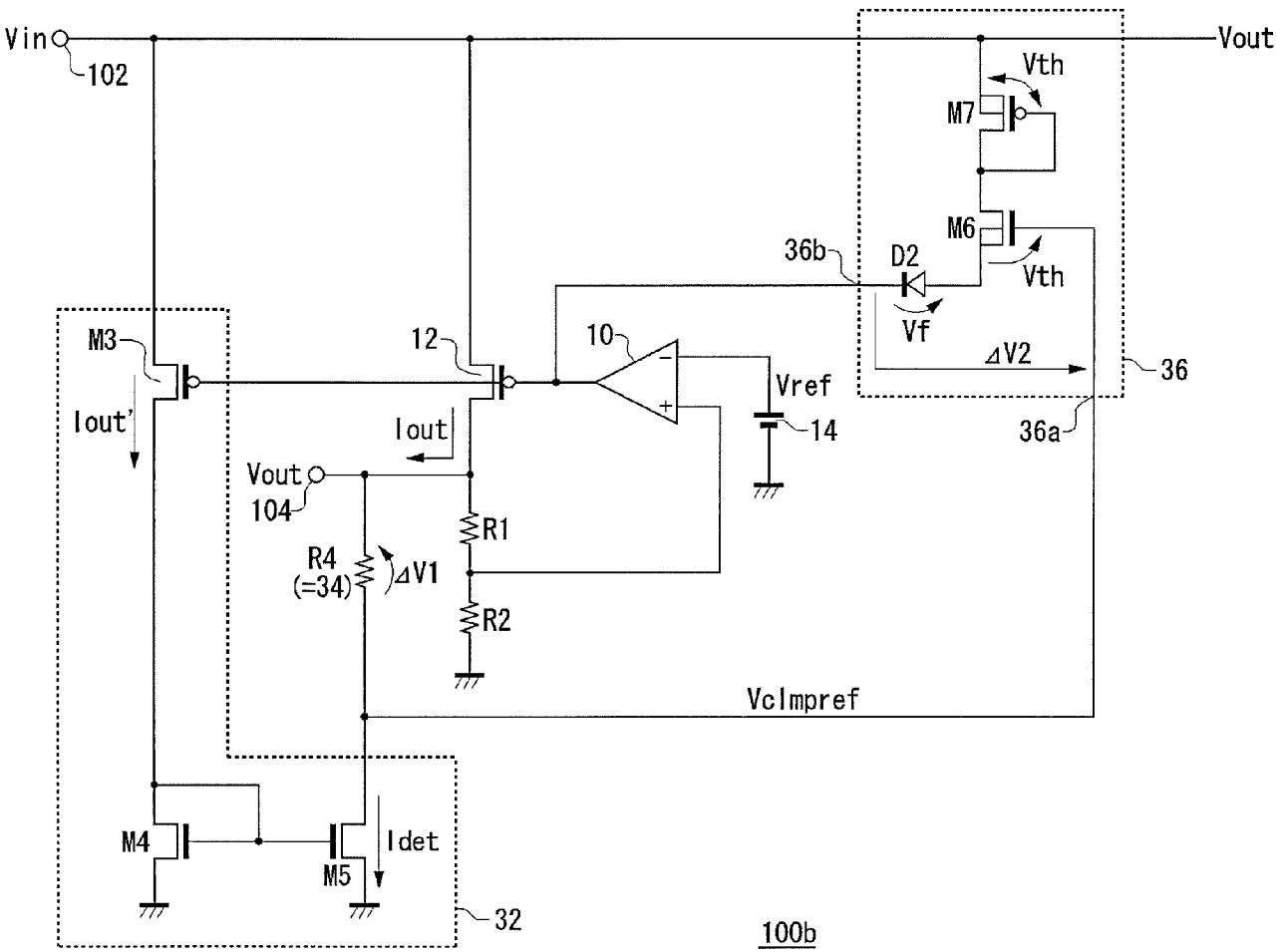
FIG. 7 is a more detailed circuit diagram which shows the regulator circuit shown in FIG. 6.

FIG. 7 is a more detailed circuit diagram which shows the regulator circuit 100*b* shown in FIG. 6. In FIG. 7, the fluctuation detection capacitor C1 and the current feedback circuit 20 are not shown.

The current detection circuit 32 includes transistors M3, M4, and M5. The transistor M3 is a P-channel MOSFET. The gate of the transistor M3 is connected to the gate of the output transistor 12, thus forming a common gate. Furthermore, the source thereof is connected to the source of the output transistor 12, thus forming a common source. The size ratio of the output transistor 12 to the transistor M3 is set to 1000:1, for example. The current Iout' flows through the transistor M3, which is proportional to the output current Iout that flows through the output transistor 12. The transistor M4 is an N-channel MOSFET, and is provided on a path for the current Iout'. The transistor M5 forms a current mirror circuit together with the transistor M4, which generates the detection current Idet which is proportional to the current Iout' with a constant factor.

With the present embodiment, the clamp reference voltage generating circuit 34 comprises a resistor R4. The resistor R4 is provided on a path for the detection current Idet generated by the current detection circuit 32, and one terminal of which is connected to the output terminal 104. With such a arrangement, the voltage drop ΔV1 occurs at the resistor R4, the value of which is obtained by multiplying the detection current Idet by the resistance value R4. That is to say, the other terminal of the resistor R4 outputs the clamp reference voltage Vclmpref (=Vout−ΔV1=Vout−Idet×R4) which is smaller than the output voltage Vout by the voltage ΔV1 that is proportional to the detection current Idet.

The clamp execution circuit 36 receives the clamp reference voltage Vclmpref and the output voltage Vout as the input signals. The clamp execution circuit 36 shown in FIG. 7 includes transistors M6 and M7, and a second diode D2. The transistor M6 is an N-channel MOSFET. With such an arrangement, the clamp reference voltage Vclmpref is applied to the gate of the transistor M6. Furthermore, the anode of the second diode D2 is connected to the source of the transistor M6. The cathode thereof is connected to the gate of the output transistor 12. Furthermore, the drain of the transistor M6 is connected to the transistor M7 which is a P-channel MOSFET in which the drain and the gate are connected to each other. The source of the transistor M7 is connected to the output terminal 104, and the output voltage Vout is applied to the source of the transistor M7. The transistor M7 is preferably provided in a pairing with the output transistor M12.

The second diode D2 is provided on a path from the output terminal of the clamp reference voltage generating circuit 34 to the gate of the output transistor 12 such that the cathode terminal thereof is connected to the gate side of the output transistor 12.

The clamp execution circuit 36 having such a configuration sets the clamp voltage Vclmp to a voltage that is lower than the clamp reference voltage Vclmpref by the voltage ΔV2. Here, the voltage ΔV2 is the sum of the gate-source threshold voltage value Vth of the transistor M6 and the forward voltage Vf of the second diode D2. On the other hand, the transistor M7 is formed so as to form a pairing with the output transistor 12. Accordingly, these two transistors have approximately the same gate-source threshold voltage Vth. Now, let us consider a case in which there are irregularities in the gate-source threshold voltage Vth of the transistor M6. Even in such a case, such an arrangement sets the voltage ΔV2 to the sum of the gate-source threshold voltage Vth of the transistor M7 and the forward voltage Vf of the second diode D2.

With the regulator circuit 100*b* having such a configuration, the clamp voltage Vclmp is reduced according to a reduction in the output voltage Vout. Thus, in a case that the input voltage Vin is lower than the target value of the output voltage Vout, the clamp voltage Vclmp is set according to the input voltage Vin. Such an arrangement more suitably suppresses overshooting of the output voltage with respect to a wide range of input voltages Vin.

Figure 8:
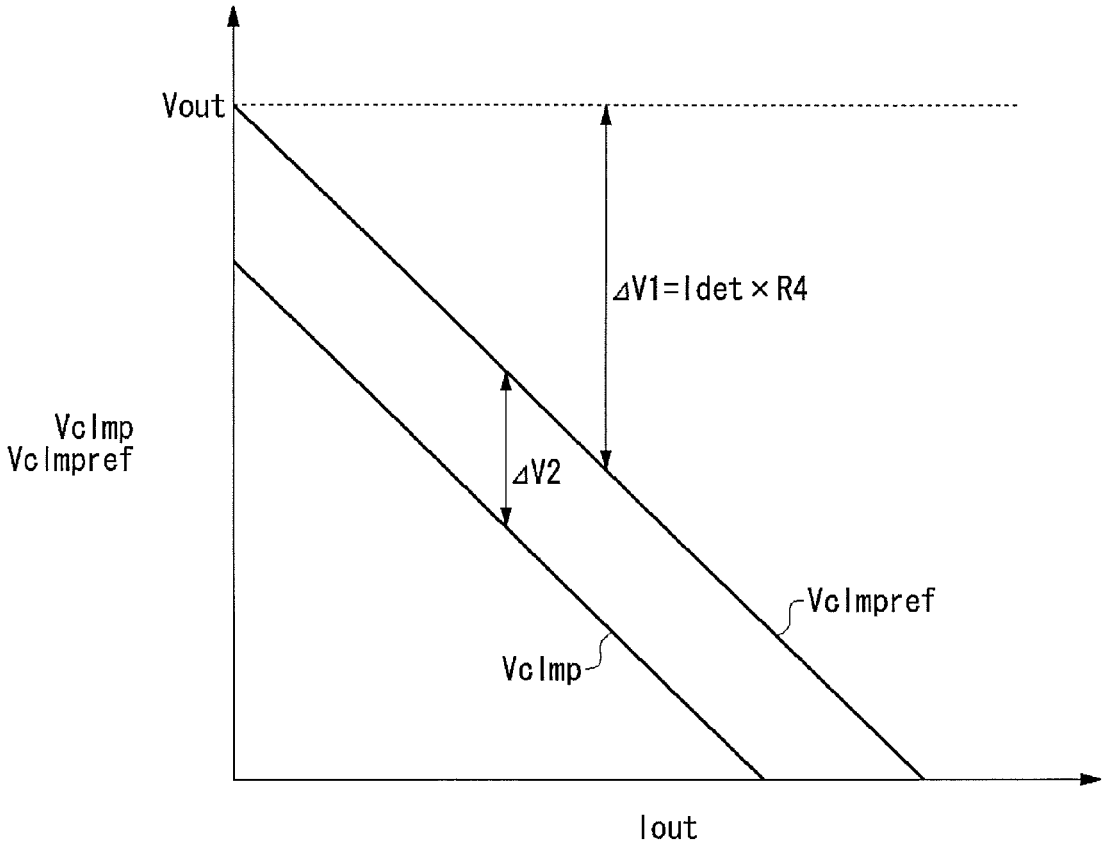
FIG. 8 is a diagram which shows the relation between the output current, the clamp voltage, and the clamp reference voltage, with respect to the regulator circuit according to the present embodiment.

FIG. 8 shows the relation between the output voltage Iout, the clamp voltage Vclmp, and the clamp reference voltage Vclmpref, with respect to the regulator circuit 100*b* according to the present embodiment. As described above, the clamp reference voltage Vclmpref is set to a value that is lower than the output voltage Vout by the differential voltage ΔV1. Here, the Expression ΔV1=Idet×R4 is satisfied. Accordingly, the clamp reference voltage Vclmpref is reduced according to an increase in the output current Iout.

The clamp voltage Vclmp is set to a voltage that is lower than the clamp reference voltage Vclmpref by the differential voltage ΔV2. Here, the differential voltage ΔV2 is represented by the Expression ΔV2=Vth+Vf. With the regulator circuit 100*b* according to the present embodiment, the clamp voltage Vclmp thus set is reduced according to an increase in the output current Iout that flows through a load.

The greater the output current Iout is, the greater is the gate-source voltage Vgs necessary to obtain a drain-source voltage Vds. With the regulator circuit 100 according to the present embodiment, in a case of applying the output voltage to a light load, the lower limit value of the gate voltage Vg is set to a high value (i.e., the upper limit value of the gate-source voltage Vg is set to a low value). Furthermore, such an arrangement has a function of reducing the lower limit value of the gate voltage Vg thus set (i.e., increasing the upper limit value of the gate-source voltage Vgs thus set) according to an increase in the load. Such an arrangement more suitably suppresses overshooting of the output voltage.

Figure 9:
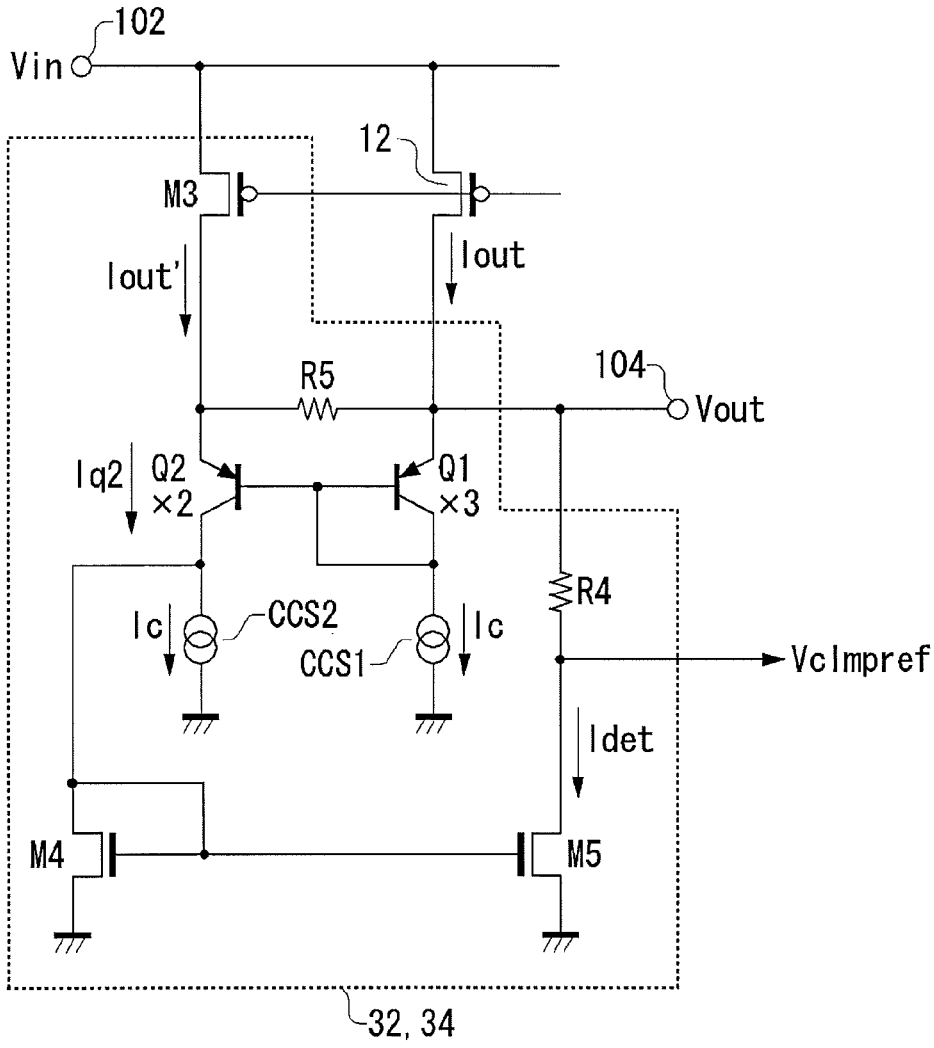
FIG. 9 is a circuit diagram which shows a modification of a current detection circuit and a clamp reference voltage generating circuit included in the regulator circuit.

FIG. 9 shows a modification of the current detection circuit 32 and the clamp reference voltage generating circuit 34 included in the regulator circuit according to the present embodiment. The current detection circuit 32 shown in FIG. 9 includes transistors M3 through M5, a resistor R5, transistors Q1 and Q2, and constant current sources CCS1 and CCS2.

The transistor M3 is connected to the output transistor 12 such that they share a common gate and a common source, thereby forming a current mirror circuit. The resistor R5 is provided between the drains of the output transistor 12 and the transistor M3. The transistors Q1 and Q2 are PNP bipolar transistors, the sizes of which differ from one another. For example, the size ratio of the transistor Q1 to the transistor Q2 is set to 3:2. The transistors Q1 and Q2 are connected to each other such that they share a common base. Furthermore, the base of the transistor Q1 is connected to the collector thereof. The emitter of the transistor Q1 is connected to the drain of the output transistor 12. The emitter of the transistor Q2 is connected to the drain of the transistor M3. The collectors of the transistors Q1 and Q2 are connected as loads to the constant current sources CCS1 and CCS2, respectively. Each of the constant current sources CCS1 and CCS2 generates the same constant current Ic. The constant current Ic is preferably set to an extremely low current value of several tens of nA to several μA.

Description will be made regarding the operation of the current detection circuit 32 having such a configuration. First, description will be made regarding a non-load state in which the amount of output current Iout flowing through the output transistor 12 is extremely small or non-existent. In this state, the same constant current Ic1 flows through each of the transistors Q1 and Q2. With such an arrangement, there is a difference in the size between the transistors Q1 and Q2, leading to a voltage difference between the emitters of the transistors Q1 and Q2, i.e., between both terminals of the resistor R5. In a case that the output current Iout is non-existent, the current flowing through the transistor Q2 is only the constant current Ic generated by the constant current source CCS2. As a result, there is no current flowing through the transistor M4, leading to the detection current Idet being 0 A.

Now, let us consider a case in which the output current Iout starts to flow through a load from the regulator circuit 100*b*. In this case, the current Iout', which is proportional to the output current Iout, flows through the transistor M3. A part of the current Iout' is supplied to the load via the resistor R5, and the other part is supplied to the transistor Q2. Accordingly, with the current flowing through the path for the transistor Q2 as "Iq2", the current (Iq2-Ic) flows through the transistor M4. Let us say that the constant current Ic is set to an extremely small value as described above. In this case, the current that flows through the transistor M4 can be represented by a current approximately proportional to the output current Iout. The transistor M5 duplicates the current flowing through the transistor M4. Then, the resistor R4 converts the current thus duplicated into voltage.

With the current detection circuit 32 shown in FIG. 9, most of the current that flows through the third transistor M3 is supplied to the load. On the other hand, there is a small amount of current that flows into the ground via the constant current source CCS2 and the transistor M4. Such an arrangement reduces the detection current Idet, thereby reducing current consumption by the circuit.

Figure 10:
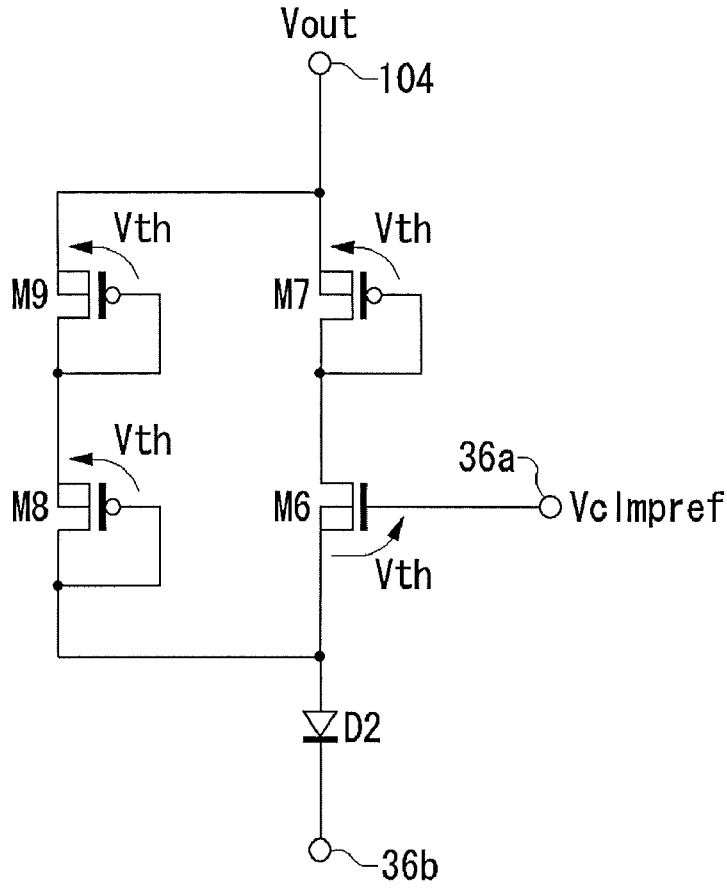
FIG. 10 is a diagram which shows another modification of a clamp execution circuit.

FIG. 10 is a circuit diagram which shows another modification of the clamp execution circuit 36. The clamp execution circuit 36 shown in FIG. 10 further includes transistors M8 and M9, in addition to the configuration of the clamp execution circuit 36 shown in FIG. 7. Each of the transistors M8 and M9 is a P-channel MOSFET in which the gate and the drain are connected to each other. The transistors M8 and M9 are serially connected to each other, and are provided between the anode of the second diode D2 and the output terminal 104. Specifically, the drain of the transistor M8 is connected to the anode of the second diode D2. Furthermore, the source of the transistor M8 is connected to the drain of the transistor M9. The source of the transistor M9 is connected to the output terminal 104. With such an arrangement, the output voltage Vout is applied to the source of the transistor M9.

Figure 11:
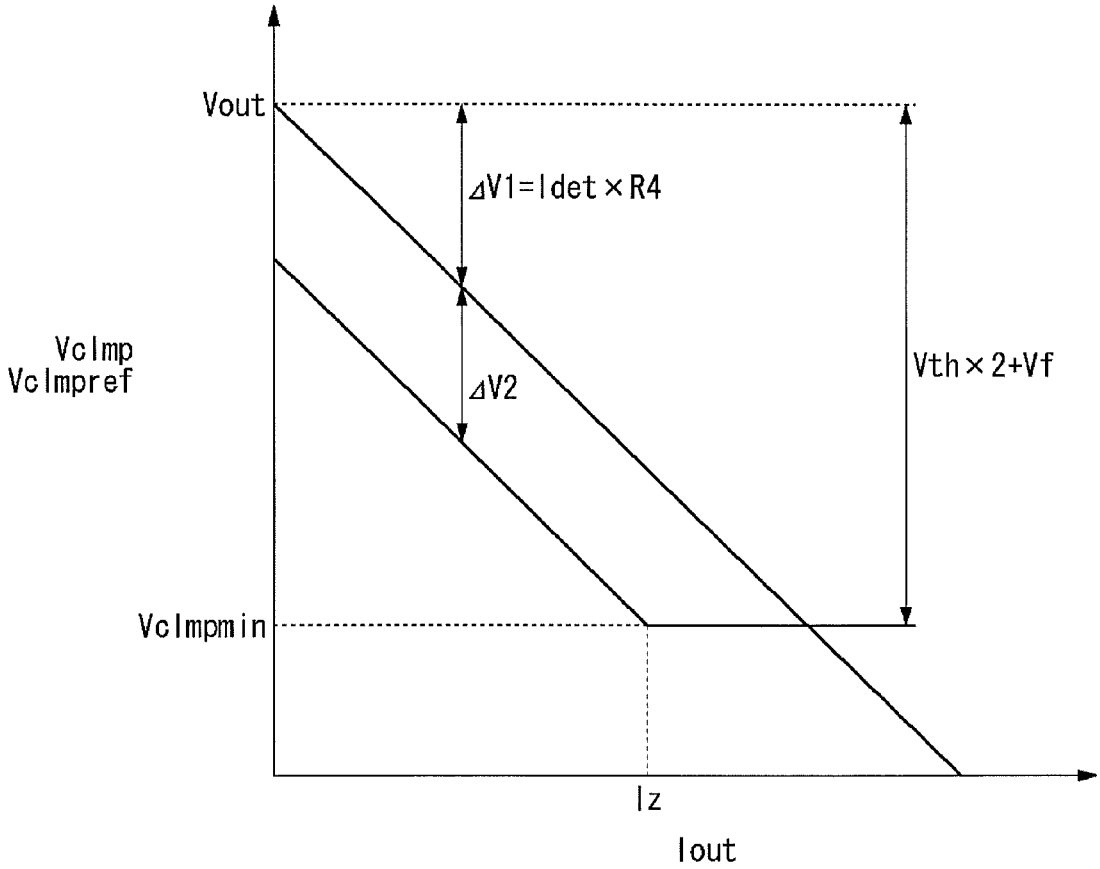
FIG. 11 is a diagram which shows the relation between the output current, the clamp voltage, and the clamp reference voltage, with respect to the clamp execution circuit shown in FIG. 10.

FIG. 11 is a diagram which shows the relation between the output current Iout and the clamp voltage Vclmp with respect to the clamp execution circuit 36 shown in FIG. 10. The clamp reference voltage Vclmpref is reduced according to an increase in the output current Iout in the same way as shown in FIG. 8. The clamp voltage Vclmp is set to a voltage that is lower than the clamp reference voltage Vclmpref by the differential voltage ΔV2. Accordingly, the clamp voltage Vclmp is reduced at a constant rate according to an increase in the output current Iout. In a case that the output current Iout is increased up to a predetermined level (Iz in FIG. 11), the gate voltage Vg is clamped by the transistors M8 and M9 and the second diode D2. Thus, such an arrangement ensures that the clamp voltage Vclmp does not drop below the minimum clamp voltage Vclmpmin. The minimum clamp voltage Vclmpmin is set to a voltage which is lower than the output voltage Vout by an amount that corresponds to the gate-source threshold voltages Vth of the transistors M8 and M9, and the forward voltage Vf of the second diode D2. That is to say, the minimum clamp voltage Vclmpmin is set to a voltage represented by the Expression Vout−(Vth×2+Vf).

As described above, such an arrangement employing the clamp execution circuit 36 shown in FIG. 10 provides a function of setting the lower limit value of the clamp voltage Vclmp according to the output voltage Vout.

Figure 12:
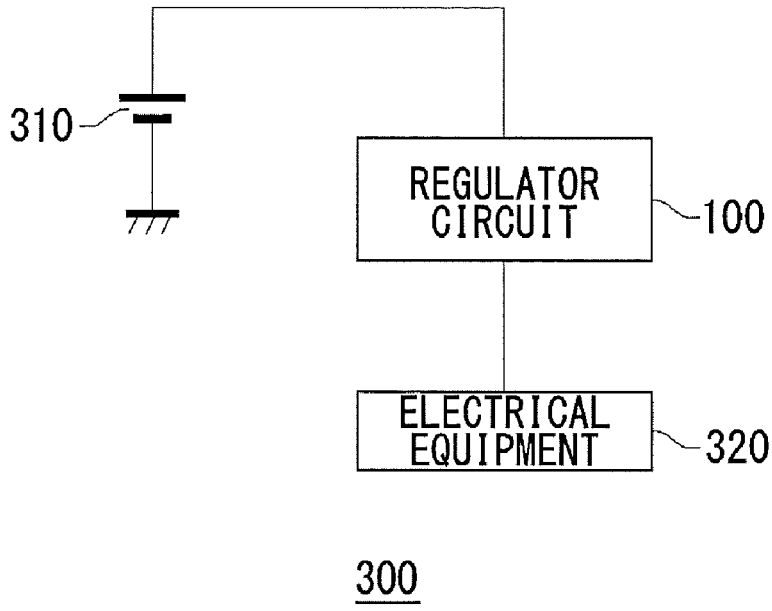
FIG. 12 is a block diagram which shows an electrical system of an automobile mounting the regulator circuit.

Lastly, description will be made regarding the uses of the above-described regulator circuit 100. The regulator circuit 100 is mounted on an automobile, for example. FIG. 12 is a block diagram which shows an electrical system of an automobile 300 mounting the regulator circuit 100. The automobile 300 includes a battery 310, the regulator circuit 100, and electrical equipment 320. The battery 310 outputs the battery voltage Vbat of around 13 V. The battery voltage Vbat is output via a relay, leading to a problem of fluctuation of the voltage value over time. On the other hand, examples of the electrical equipment 320 include a car stereo system, a car navigation system, illumination LEDs provided to an interior panel, etc., each of which is a load that requires a stable power supply voltage. The regulator circuit 100 reduces the battery voltage Vbat to a predetermined voltage, and outputs the voltage thus reduced to the electrical equipment 320.

As described above, the regulator circuit 100 described in the embodiments has a function of high speed control of the output voltage Vout following a rapid change in the input voltage Vin or the output voltage Vout, thereby almost entirely suppressing undershooting and overshooting of the output voltage Vout. Thus, the regulator circuit 100 can be suitably employed in order to obtain a stable voltage from a power supply that has a problem of large fluctuations in the output voltage, such as a battery mounted on an automobile.

The use of the regulator circuit 100 described in the embodiments is not restricted to such use in an automobile. Also, the regulator circuit 100 can be applied to various applications in which the input voltage is stabilized before the input voltage is supplied to a load.

The above-described embodiments have been described for exemplary purposes only, and are by no means intended to be interpreted restrictively. Rather, it can be readily conceived by those skilled in this art that various modifications may be made by making various combinations of the aforementioned components or processes, which are also encompassed in the technical scope of the present invention.

Each of the components of the regulator circuit 100 according to the embodiments provides the above-described functions and advantages in a case that the component is employed independently. Also, any combination thereof may be made. Such a combination more properly and suitably suppresses undershooting and overshooting of the output voltage. For example, the clamp circuit 30 shown in FIG. 1 may comprise both the clamp circuit 30*a* shown in FIG. 4 and the clamp circuit 30*b* shown in FIG. 6 or FIG. 7.

Description has been made for exemplary purposes regarding suitable configurations of the clamp circuit 30, the current detection circuit 32, the clamp reference voltage generating circuit 34, and the clamp execution circuit 36. However, the present invention is not restricted to such configurations. For example, the clamp execution circuit 36 may have a circuit configuration in which the target voltage is clamped using another voltage as a reference.

In the embodiments, each MOSFET employed for exemplary purposes may be replaced by a bipolar transistor. Also, each bipolar transistor employed for exemplary purposes maybe replaced by a MOSFET. Also, a modification may be made in which the relation between the power supply voltage and the grounded electric potential is inverted as compared to that in the present embodiment. With such a modification, each P-channel MOSFET is replaced by an N-channel MOSFET, and each PNP transistor is replaced by a corresponding NPN transistor. Also, an additional resistor may be inserted. It is needless to say that such a modification is also encompassed in the technical scope of the present invention. These transistors are interchangeable. Any interchanging of these transistors should be determined based upon the design specifications required in designing the regulator circuit, the semiconductor manufacturing process used for manufacturing the regulator circuit, and so forth.

In the embodiments, all the components of the regulator circuit 100 may be integrally formed. Also, a part thereof may be provided in the form of a discrete component. Which part is to be provided in the form of an integrated circuit should be determined based upon costs, the amount of space to be occupied, etc.

While the preferred embodiments of the present invention have been described using specific terms, such description is for illustrative purposes only, and it is to be understood that changes and variations may be made without departing from the spirit or scope of the appended claims.

What is claimed is:

1. A regulator circuit, which stabilizes an input voltage applied to an input terminal, and which outputs an output voltage via an output terminal, comprising:

an output transistor provided between the input terminal and the output terminal;

an error amplifier which adjusts a voltage at a control terminal of said output transistor such that the voltage that corresponds to the output voltage approaches a predetermined reference voltage;

a fluctuation detection capacitor which is provided on a path from the input terminal to the grounded terminal, and one terminal of which is set to a fixed electric potential;

a current feedback circuit which supplies, to the control terminal of said output transistor, a current proportional to the current that flows through said fluctuation detection capacitor; and a clamp circuit which clamps the voltage of the control terminal of said output transistor.

2. A regulator circuit according to claim 1, wherein said clamp circuit clamps the voltage at the control terminal of said output transistor such that the voltage difference between the control terminal of said output transistor and said input terminal exhibits a predetermined clamp voltage or more.

3. A regulator circuit according to claim 2, wherein said clamp circuit operates during a period of time in which there is a current flowing through said fluctuation detection capacitor.

4. A regulator circuit according to claim 2, wherein said output transistor is a P-channel field effect transistor, and wherein the clamp voltage is set to a value smaller than the threshold voltage of said output transistor.

5. A regulator circuit according to claim 1, wherein said clamp circuit includes a diode provided on a current supply path from said current feedback circuit to the control terminal of said output transistor, and wherein the cathode of said diode is connected to the control terminal side of said output transistor, and wherein the anode of said diode is connected to the said current feedback circuit side.

6. A regulator circuit according to claim 1, wherein said clamp circuit includes a resistor provided on a current supply path from said current feedback circuit to the control terminal of said output transistor.

7. A regulator circuit, which stabilizes an input voltage applied to an input terminal, and which outputs an output voltage via an output terminal, comprising:

an output transistor provided between the input terminal and the output terminal;

an error amplifier which adjusts a voltage at a control terminal of said output transistor such that the voltage that corresponds to the output voltage approaches a predetermined reference voltage;

a fluctuation detection capacitor which is provided on a path from the input terminal to the grounded terminal, and one terminal of which is set to a fixed electric potential;

a current feedback circuit which supplies, to the control terminal of said output transistor, a current proportional to the current that flows through said fluctuation detection capacitor; and a clamp circuit which clamps the voltage of the control terminal of said output transistor;

wherein said clamp circuit includes a diode provided on a current supply path from said current feedback circuit to the control terminal of said output transistor, and wherein the cathode of said diode is connected to the control terminal side of said output transistor, and wherein the anode of said diode is connected to the said current feedback circuit side; and wherein said current feedback circuit comprises:

a first transistor provided on a path from said input terminal to the other terminal of said fluctuation detection capacitor; and a second transistor which forms a current mirror circuit together with said first transistor, wherein said current feedback circuit supplies, to the control terminal of said output transistor via said clamp circuit, a current flowing through said second transistor.

8. A regulator circuit, which stabilizes an input voltage applied to an input terminal, and which outputs an output voltage via an output terminal, comprising:

an output transistor provided between the input terminal and the output terminal;

an error amplifier which adjusts a voltage at a control terminal of said output transistor such that the voltage that corresponds to the output voltage approaches a predetermined reference voltage;

a fluctuation detection capacitor which is provided on a path from the input terminal to the grounded terminal, and one terminal of which is set to a fixed electric potential;

a current feedback circuit which supplies, to the control terminal of said output transistor, a current proportional to the current that flows through said fluctuation detection capacitor; and a clamp circuit which clamps the voltage of the control terminal of said output transistor;

wherein said clamp circuit includes a resistor provided on a current supply path from said current feedback circuit to the control terminal of said output transistor;

wherein said current feedback circuit includes;

a first transistor provided on a path from said input terminal to the other terminal of said fluctuation detection capacitor; and a second transistor which forms a current mirror circuit together with said first transistor, wherein said current feedback circuit supplies, to the control terminal of said output transistor via said clamp circuit, a current flowing through said second transistor.

9. A regulator circuit according to claim 1, wherein said clamp circuit sets the clamp voltage to a voltage which is lower than the output voltage by a differential voltage, and wherein said clamp circuit clamps the voltage at the control terminal of said output transistor so as to be at least the clamp voltage thus set.

10. A regulator circuit according to claim 9, wherein said clamp circuit sets the clamp voltage using as the differential voltage a voltage which is increased according to the output current that flows through said output transistor.

11. A regulator circuit, which stabilizes an input voltage applied to an input terminal, and which outputs an output voltage via an output terminal, comprising:

an output transistor provided between the input terminal and the output terminal;

an error amplifier which adjusts a voltage at a control terminal of said output transistor such that the voltage that corresponds to the output voltage approaches a predetermined reference voltage;

a fluctuation detection capacitor which is provided on a path from the input terminal to the grounded terminal, and one terminal of which is set to a fixed electric potential;

a current feedback circuit which supplies, to the control terminal of said output transistor, a current proportional to the current that flows through said fluctuation detection capacitor; and a clamp circuit which clamps the voltage of the control terminal of said output transistor;

wherein said clamp circuit sets the clamp voltage to a voltage which is lower than the output voltage by a differential voltage;

wherein said clamp circuit clamps the voltage at the control terminal of said output transistor so as to be at least the clamp voltage thus set;

wherein said clamp circuit sets the clamp voltage using as the differential voltage a voltage which is increased according to the output current that flows through said output transistor;

wherein said clamp circuit includes:

a current detection circuit which generates a detection current that corresponds to the output current that flows through said output transistor;

a clamp reference voltage generating circuit which generates a clamp reference voltage that is lower than the output voltage by a voltage which is proportional to the detection current; and a clamp execution circuit which sets the clamp voltage to a voltage which is lower by a predetermined voltage than the clamp reference voltage thus generated by said clamp reference voltage generating circuit.

12. A regulator circuit according to claim 11, wherein said clamp reference voltage generating circuit includes a resistor, one terminal of which is connected to said output terminal, and which is provided on a path for the detection current generated by said current detection circuit, and wherein the voltage at the other terminal of said resistor is output as the clamp reference voltage.

13. A regulator circuit according to claim 11, wherein said clamp execution circuit includes a diode which is provided on a path from the output terminal of said clamp reference voltage generating circuit to the control terminal of said output transistor such that the cathode terminal thereof is connected to the control terminal side of said output transistor.

14. A regulator circuit according to claim 12, wherein said clamp execution circuit includes:

an N-channel field effect transistor, with the clamp reference voltage applied to the gate thereof; and a diode, the anode of which is connected to the source of said N-channel field effect transistor, and the cathode of which is connected to the control terminal of said output transistor.

15. A regulator circuit according to claim 1, wherein said circuit is integrally formed on a single semiconductor substrate.

16. An automobile including:

a battery; and a regulator circuit according to claim 1, which stabilizes the voltage supplied from said battery before supplying the output voltage to a load.

17. A regulator circuit, which stabilizes an input voltage applied to an input terminal, and which outputs an output voltage via an output terminal, comprising:

an output transistor provided between the input terminal and the output terminal;

an error amplifier which adjusts a voltage at a control terminal of said output transistor such that the voltage that corresponds to the output voltage approaches a predetermined reference voltage;

a fluctuation detection capacitor which is provided on a path from the input terminal to the grounded terminal, and one terminal of which is set to a fixed electric potential; and a current feedback circuit which supplies, to the control terminal of said output transistor, a current that corresponds to the current that flows through said fluctuation detection capacitor, wherein said current feedback circuit includes:

a first transistor provided on a path from said input terminal to the other terminal of said fluctuation detection capacitor; and a second transistor which forms a current mirror circuit together with said first transistor, and wherein said current feedback circuit supplies, to the control terminal of said output transistor via said clamp circuit, a current flowing through said second transistor.

18. A regulator circuit according to claim 17, further comprising:

a clamp circuit provided on a current path between said current feedback circuit and the control terminal of said output transistor and configured to clamp the voltage of the control terminal of said output transistor.

* * * * *